US007698772B1

(12) United States Patent
Hauser, Jr.

(10) Patent No.: US 7,698,772 B1
(45) Date of Patent: Apr. 20, 2010

(54) ORTHODONTIC TOOTHBRUSH

(76) Inventor: Thomas Meskell Hauser, Jr., 2369 Landings Cir., Bradenton, FL (US) 34209

( * ) Notice: Subject to any disclaimer, the term of this patent is extended or adjusted under 35 U.S.C. 154(b) by 1183 days.

(21) Appl. No.: 11/233,765

(22) Filed: Sep. 22, 2005

Related U.S. Application Data

(60) Provisional application No. 60/612,030, filed on Sep. 22, 2004.

(51) Int. Cl.
*A46B 9/04* (2006.01)
*A46B 7/04* (2006.01)
*A46B 3/18* (2006.01)

(52) U.S. Cl. ..... 15/167.2; 15/167.1; 15/176.1; 15/206

(58) Field of Classification Search ..... 15/167.1, 15/167.2, 22.1, 22.2, 171, 175, 206, 207, 15/207.2; 433/80, 216
See application file for complete search history.

(56) References Cited

U.S. PATENT DOCUMENTS 3,015,833 A * 1/1962 Gilet ..... 15/23
4,317,463 A * 3/1982 Massetti ..... 15/167.1
4,377,877 A * 3/1983 O'Rourke ..... 15/4
4,716,614 A * 1/1988 Jones et al. ..... 15/105
5,435,033 A * 7/1995 Millner ..... 15/22.1
5,537,708 A 7/1996 Luposello

* cited by examiner

*Primary Examiner*—Joseph J Hail, III
*Assistant Examiner*—Jamal Daniel
(74) *Attorney, Agent, or Firm*—Dorothy S. Morse

(57) ABSTRACT

A toothbrush with a head having at least one pair of twisted wire brushes secured to the head's top surface in a position that creates a narrow and substantially uniform trench between the bristles of opposing brushes. Head construction may be solid, curved, blunt, tapering, or have a forked distal end. When a user's brace hardware and/or orthodontic wires are placed within the trench, bristles adjacent to it reach tooth surfaces behind the orthodontic wires to gently remove plaque without wire or hardware breakage. The twisted wires of opposing conical brushes are not parallel so as to create a uniform trench. The twisted wires in narrow end of conical brushes are also angled toward the distal end of the toothbrush head to facilitate reaching crowded back teeth without orthodontic wire breakage. The toothbrush handle can be laterally angled relative to its head and brushes are optionally replaceable by the user.

13 Claims, 4 Drawing Sheets

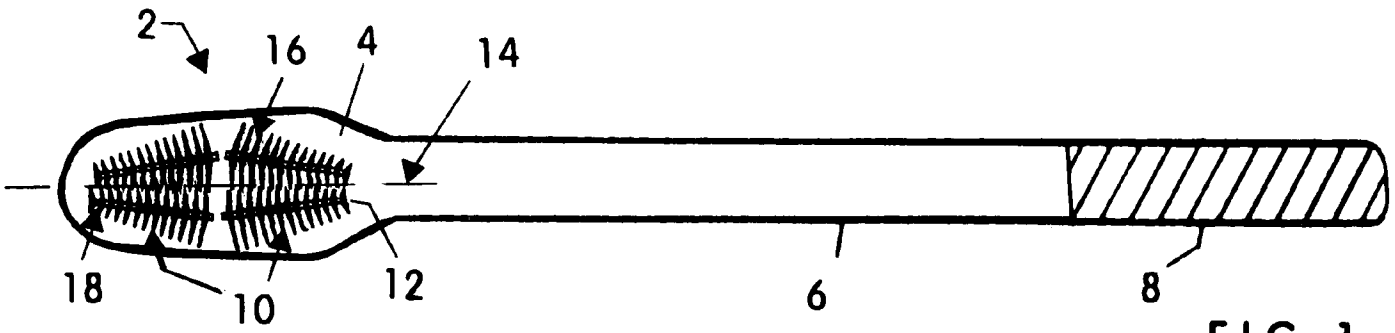
FIG. 1
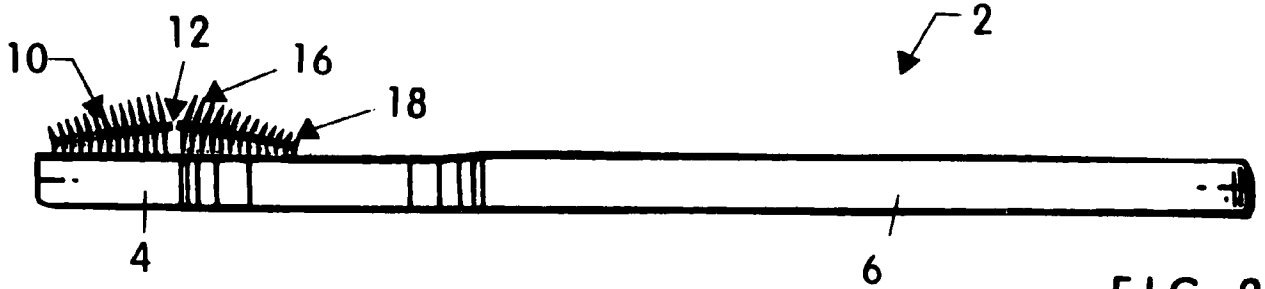
FIG. 2
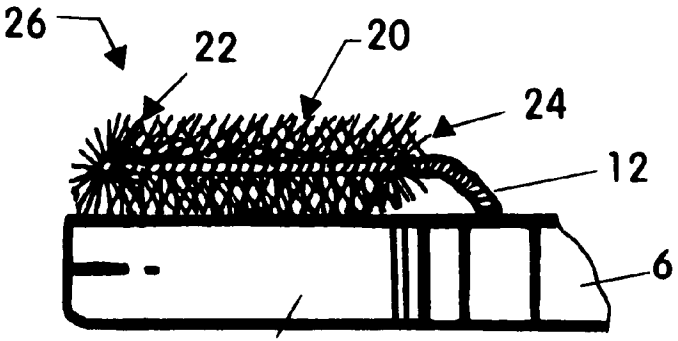
FIG. 4
FIG. 3

ORTHODONTIC TOOTHBRUSH

CROSS-REFERENCES TO RELATED APPLICATIONS

This application relates to U.S. provisional patent application No. 60/612,030, filed by the same inventor for substantially the same subject matter on Sep. 22, 2004.

BACKGROUND

1. Field of the Invention

This invention relates to toothbrushes used by orthodontic patients having braces, specifically to a toothbrush with a head having at least one pair of longitudinally extending twisted wire brushes secured thereto, sometimes called proxy brushes, which are positioned so as to provide a very narrow but uniform trench between brush bristles along a substantial portion of the head. The trench permits brush bristles to reach farther behind the orthodontic wire for removal of food and plaque from tooth surfaces, than otherwise could be accomplished with any known prior art device. One or two pairs of twisted wire brushes are preferred, but the number used is not critical. Also, conical brushes are preferred over substantially cylindrical brushes, although either can be used. The most preferred embodiment of the present invention would provide two pairs of conical brushes, with the wider end of each conical brush adjacent to the others in the middle portion of the toothbrush head so that the longer brush bristles in the middle of the toothbrush head are able to effectively reach behind an orthodontic wire for tooth cleaning and the shorter brush bristles near the distal end of the toothbrush head remain compact for reaching into the limited space between cheek and gums around back teeth and being withdrawn without damage to the orthodontic appliances and/or injury to the person wearing them. The toothbrush head may employ a solid, blunt, curved, tapering, and/or forked end construction for support of the pair or multiple pairs of twisted wire brushes that form the narrow trench for orthodontic wire passage. The trench is useful when placed into a horizontally-extending orientation around the horizontally-extending orthodontic wire of the braces connected between the complementary hardware wrapped around each tooth, whereby brush bristles adjacent to the trench are able to move behind the orthodontic wires, without damaging them, and clean surfaces of the teeth typically inaccessible by other types of orthodontic cleaning devices. When conical brushes are used, the twisted wires of the present invention are not parallel, nor are the twisted wires positioned at a uniform spaced-apart distance from the toothbrush head. Instead, to create the substantially uniform trench needed between adjacent bristles, the twisted wires of the conical brushes are angled laterally relative to the head surface so that the twisted wires at the narrow end of the conical configuration are more closely positioned together. Also, the twisted wires at the narrow end of the conical configuration angle toward the head surface to give it a more compact structure so that the distal end of the present invention head with its attached brushes can be easily manipulated between the user's cheek and back teeth for effective tooth cleaning behind the orthodontic wires, and thereafter be easily withdrawn from the user's mouth without damage to the orthodontic hardware attached to the teeth or the orthodontic wires connected between them. The brush bristles positioned directly between the twisted wires and adjacent to the trench, are positioned very close to one another or set into a slightly overlapping configuration. In some embodiments of the present invention, it is contemplated for the handle attached to the toothbrush head to be laterally angled to allow a user to hold it like a pencil and more conveniently align the orthodontic wires with the trench, as well as allow the user to clean teeth with his or her supporting hand and arm in a lowered and less awkward position that prevents premature fatigue. Also, some embodiments of the present invention may optionally have easily replaced brush bristles, be considered disposable as an entire unit when bristles wear out and no longer provide effective tooth cleaning, after a limited number of uses, or be electric to provide counter-rotating bristles that pull food out of orthodontic appliances.

2. Description of the Related Art

When brace hardware and orthodontic wires are connected to teeth, food easily collects on exposed and hidden tooth surfaces in and around the tooth hardware and behind the orthodontic wires, and is difficult to remove. If not frequently cleaned, plaque will form and lead to tooth decay. However, the aggressive tooth cleaning sometimes required to remove plaque from exposed and hidden tooth surfaces behind orthodontic wires and complementary tooth hardware, particularly when working around back teeth, is likely to break the orthodontic wires. Also, molars and other back teeth, which are even difficult to clean when no brace hardware and orthodontic wires are present, are even more difficult to clean when the limited space between cheek and gums is occupied in part by orthodontic wires and complementary tooth hardware. Further, much orthodontic work is performed on teens and pre-teens, and many of them have small mouths, making it even more difficult to insert an effective cleaning device between the cheek and gums that is able to clean plaque from tooth surfaces without damaging orthodontic wires. While most prior art tooth cleaning devices, including water irrigation devices and twisted wire brushes used individually, are able to remove a significant amount of food from the brace hardware and orthodontic wires, most are unable to effectively remove plaque from tooth surfaces located behind the orthodontic wires and complementary brace hardware, and/or are too wide or thick in dimension to effectively operate in the limited space between cheek and gum to remove plaque from the crowded back teeth of teens and pre-teens.

The invention thought to be most closely related to the present invention is the toothbrush disclosed in U.S. Pat. No. 5,537,708 to Luposello (1996). However, significant differences exist between the Luposello invention and the present invention. The Luposello invention discloses a toothbrush and orthodontic appliance cleaning device having a cleaning head with upstanding standard toothbrush bristles extending perpendicularly from the head. In addition, two elongated twisted wire brush members are supported upon the standard bristles in a parallel orientation to the head. The Luposello invention identifies use in cleaning braces, teeth, and gingival surfaces. However, the mouths of teen and pre-teen dental patients are small, and the distal end of the Luposello invention head, with its upstanding bristles and superimposed twisted wires brushes, would be too thick to reach in and around back teeth to effectively clean plaque from the back teeth without risk of damage to orthodontic wires. Further, the gap shown between the Luposello elongated brush bristles is much larger than the nearly overlapping, or slightly overlapping, bristles adjacent to the present invention trench. Also, FIG. 7 in the Luposello disclosure shows the large Luposello gap being used in a vertical orientation relative to a tooth, to clean around the width of the brace hardware attached to the tooth. However, its large gap would prevent it from being as effective as the present invention for removing plaque from the entire tooth surface behind orthodontic wires and tooth brackets. In contrast, the present invention is contemplated for tooth cleaning when its trench is in a substantially horizontally-extending orientation, with an orthodontic wire passing through the trench and not perpendicular to it, which allows the nearly overlapping or slightly overlapping twisted wire brush bristles of the present invention to interact with one another, and as a result of the combined brush activity provided, effectively clean all tooth surfaces behind an orthodontic wire and its attached tooth brackets. Further, if the Luposello invention would be used with its gap in a horizontally-extending position, its elongated brush bristles are much too far apart to reach fully behind the orthodontic wires connected between the brace hardware attached to each tooth, and the standard upstanding toothbrush bristles beneath the Luposello will collapse when placed in contact with the orthodontic wire and not be able to reach around it to effectively remove plaque from all tooth surfaces behind the orthodontic wire. In addition, even though the Luposello invention discloses the use of conical elongated brushes, the twisted wires in all embodiments of the Luposello invention remain parallel to one another (see FIGS. 1, 3, 5, and 8), so that the gap/trench between them is even wider at the narrow end of a conical brush, which would make the Luposello invention even less effective in cleaning plaque from tooth surfaces behind orthodontic wires and tooth hardware. Also, as shown in FIG. 2 of the Luposello disclosure, its elongated twisted wire brushes are raised above the surface of the upstanding standard toothbrush bristles where they provide a thick profile and are likely to become entangled with orthodontic wires or brace members when used to clean crowded back teeth. Such entanglement may either cause the orthodontic wires to bend or break, cause out-of-position movement for one or more of the elongated twisted wire brushes, cause movement of one or more of the elongated twisted wire brushes away from the toothbrush head, or some combination thereof. Exposed wires and fragments from repositioned twisted wire brushes, broken orthodontic wires, and/or damaged brace hardware, not only places the inside check surface of the person wearing the braces at risk for injury, it risks further damage to the orthodontic appliances. The present invention tooth cleaning device always maintains a narrow trench of uniform dimension between the bristles of all elongated brushes secured to its head, with adjacent bristle ends overlapping or nearly overlapping one another, so that when the trench is in a horizontally-extending position and an orthodontic wire moves through the trench, adjacent bristles reach behind the orthodontic wire to effectively clean plaque from all tooth surfaces behind the orthodontic wire and adjacent brace hardware attached to the teeth. The twisted wires in the conical brushes of the present invention are not always oriented parallel to the head, as is shown in Luposello FIGS. 1, 2, and 4. Instead, the present invention teaches angled brushes that are also able to effectively clean crowded back teeth, particularly in the small mouths of teens and pre-teens. Further, the Luposello invention does not disclose a laterally angled head for facilitated horizontal positioning of its trench during tooth cleaning use, nor does the Luposello invention teach the use of replaceable elongated brushes. No other system and method is known that functions in the same manner or provides all of the advantages of the present invention.

BRIEF SUMMARY OF THE INVENTION

It is the primary object of this invention to provide a toothbrush that can place brush bristles behind the orthodontic wires connecting together the dental brace hardware attached to individual teeth, to effectively clean food and plaque from all of the exposed and hidden surfaces of the teeth in and around the orthodontic appliances. It is also an object of this invention to provide a toothbrush that has a compact size and shape for effective use in small teen or pre-teen mouths. A further object of this invention is to provide a toothbrush that will not damage the orthodontic wires when it is withdrawn from a mouth, or in any way cause injury to the user's cheeks and gums. It is also an object of this invention to provide a toothbrush that has a configuration conducive to comfortable use in a hand so that during the extended process required for cleaning teeth behind the orthodontic wires and connecting tooth hardware the user's hand and arm is not likely to prematurely tire before a thorough cleaning of the tooth surfaces can be achieved. It is a further object of this invention to provide a toothbrush that has durable construction and is cost effective to use.

The present invention, when properly made and used, will provide a person having orthodontic braces a means for effectively cleaning the tooth surfaces behind orthodontic wires and tooth hardware without presenting a risk for damage to the orthodontic wires or the complementary hardware attached to each tooth. The uniformly wide trench between the one or more pairs of twisted wire brushes used in a present invention device, with adjacent brush bristles always nearly or slightly overlapping, permits brush bristles to move behind the orthodontic wires and reach all tooth surfaces in and about the orthodontic wires and individual tooth hardware for food and plaque removal. The present invention embodiments using conical twisted wire brushes are particularly effective in small teen and pre-teen mouths, due to the compact and tapering configuration of the combined brush bristle and toothbrush head that allows facilitated brush bristle movement in and around crowded back teeth, without risk of injury to the braces or the user's cheek and gums during the tooth cleaning process or as the device is withdrawn from the limited back teeth space between cheek and gums. However, if the toothbrush head is sufficiently small in thickness dimension or has an upper surface that narrows in thickness toward its free end, the use of conical twisted wire brush bristles with their distal tapering would not provide a significant advantage over the use of twisted wire brushes having a cylindrical bristle configuration. Optionally, the toothbrush head can have a split end, similar to that of a tuning fork, to enhance the reach of brush bristles behind orthodontic wires for contact with tooth surfaces, particularly in the limited space between cheek and gums adjacent to back teeth. The gap in the split end of the toothbrush head also eliminates the otherwise repeated contact of the free end of the toothbrush head with orthodontic wires that would occur and create a risk of wire breakage. Where desired for facilitated removal of a present invention device without unwanted repositioning of one or more of the elongated twisted wire brushes attached to its toothbrush head, particularly for toothbrush heads having a split end configuration and/or replaceable twisted wire brushes, a sliding cap or hood may be employed during tooth cleaning use to maintain the distal ends of the elongated twisted wire brushes in a fixed and close association with the toothbrush head. However, any tooth cleaning process is only as effective as the person conducting it, and whether that person is willing and able to devote a sufficient amount of time to complete it in a thorough and standardized manner. If part way through the tooth cleaning process the arm of a person conducting it begins to tire, effective tooth cleaning is likely to be compromised. To remedy this potential problem, some present invention toothbrush heads are angled laterally approximately 45° relative to its attached handle. With lateral angling the user is able to hold the toothbrush handle in a pencil-like manner with his or her elbow and upper arm maintained in a position close to the body, instead of in a position that uncomfortably extend the arm away from the body and would require more energy to maintain during the prolonged time period expected for accomplishing a thorough cleaning of tooth surfaces behind orthodontic appliances. Although not limited thereto, when a lateral head/handle angle is used in a present invention toothbrush embodiment, an angle between approximately 30° and 60° from vertical is preferred. Further, although not shown, it is also considered for some present invention embodiments to have a toothbrush head that is forwardly angled relative to its attached handle. However, lateral angling is generally preferred over forward angling, as it has been demonstrated that laterally angling helps to maintain orthodontic wires in the trench when tooth cleaning bristle motion occurs, particularly when crowded back teeth are being accessed. In addition, although not limited thereto, the toothbrush handle in the most preferred embodiment of the present invention would have a maximum length dimension sufficient only for a hand to be able to use it in a controlled manner to reach and effectively clean back teeth. Although long toothbrush handles are considered within the scope of the present invention, a smaller handle is easier for teen and pre-teen use, and it is more cost efficient to manufacture. Non-disposable preferred embodiments of the present invention, and even embodiments contemplated for a small number of repeat uses, would have durable construction, with brush bristles being made from plastic, nylon, and/or natural fibers. The length of use for the different preferred embodiments of the present invention would also be expected to vary. Further, some preferred embodiments of the present invention would permit user replacement of twisted wire brushes, while other preferred embodiments would be discarded in their entirety after a limited number of uses. In addition, the uniform trench of the present invention lends itself to electric rotation of brush bristles that would provide expedited and enhanced cleaning of tooth surfaces behind orthodontic wires and brace hardware. Attachment of the twisted wire brushes to the toothbrush head of the present invention can be accomplished in several ways, to include but not be limited to adhesives and/or bonding agents, physical insertion of a twisted wire into the toothbrush head, and use of an end cap or hood that slides over in a protective manner the combined distal end thickness of toothbrush head and twisted wire brush.

The description herein provides preferred embodiments of the present invention but to should not be construed as limiting its scope. For example, variations in the number of twisted wire brushes used; whether the twisted wire brushes would be replaceable; the angle at which the handle is optionally bent relative to the toothbrush head so that a user's arm does not prematurely tire before a thorough cleaning of tooth surfaces can be accomplished; the configuration of the free end of the toothbrush head; the rigidity of the bristles; the optional use of one or more hoods or caps with replaceable brush embodiments; and the means by which the twisted wire bristles are attached to the head, other than those shown and described herein, may be incorporated into the present invention. Thus the scope of the present invention should be determined by the appended claims and their legal equivalents, rather than being limited to the examples given.

BRIEF DESCRIPTION OF THE DRAWINGS

FIG. 1 is a front view of a first preferred embodiment of the present invention having two pairs of conical twisted wire brushes forming a trench capable of containing an orthodontic wire to allow brush bristles to effectively reach behind the orthodontic wire and adjacent orthodontic hardware attached to the teeth for tooth cleaning, with brush bristles very slightly overlapping and the wider ends of the tapering conical brushes secured to the middle portion of a solid-tipped toothbrush head, and also with the toothbrush head being substantially aligned with the toothbrush handle.

FIG. 2 is a side view of the first preferred embodiment of the present invention.

FIG. 3 is a side view of a second preferred embodiment of the present invention having one pair of cylindrical twisted wire brushes secured to a toothbrush head, with the twisted wire of each brush being attached to the proximal end of the toothbrush head.

FIG. 4 is a side view of a third preferred embodiment of the present invention having two pairs of conical twisted wire brushes attached to the toothbrush head, with the twisted wire of each brush being attached to the middle portion of the toothbrush head.

DETAILED DESCRIPTION OF PREFERRED EMBODIMENTS

Figure 6:
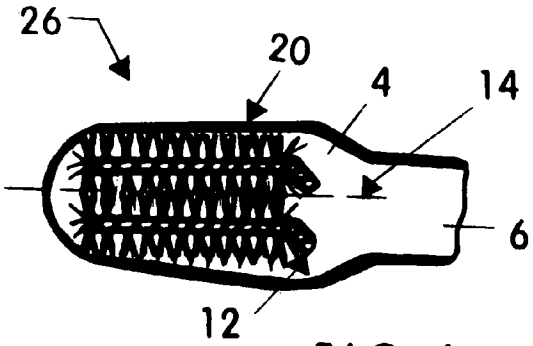
FIG. 6 is a front view of the second preferred embodiment of the present invention having two pairs of cylindrical twisted wire brushes secured to a solid-tipped toothbrush head, with the twisted wire of each brush being attached to the proximal end of the toothbrush head, and further with brush bristles slightly overlapping.

The present invention provides a toothbrush having at least one pair of twisted wire brushes 10 or 20 secured to its head 4 so as to create a narrow and substantially uniform trench 14 between opposing brush bristles 10 or 20 so that when trench 14 is placed into a substantially horizontally-extending position and orthodontic wires (not shown) are placed within trench 14, the brush bristles 10 or 20 are able to reach tooth surfaces (not shown) behind the orthodontic wire, as well as behind complementary tooth hardware, and through combined interactive bristle movement achieve effective removal of food and plaque from tooth surfaces to prevent tooth decay. While prior art orthodontic cleaning devices (not shown), including mouth irrigation devices, are able to remove food from the orthodontic hardware and many tooth surfaces, the aggressive cleaning action typically required with these devices to reach all tooth surfaces will often damage the orthodontic wires. The present invention trench 14 allows for the proper reach of brush bristles 10 and 20 behind orthodontic wires so that gentle cleaning action of touching or slightly overlapping bristles is able to accomplish the level of food and plaque removal needed to prevent tooth decay during the entire term of orthodontic appliance use. While the head 4 of a present invention device may alternatively employ a solid, blunt, curved, tapering, or forked end construction for brush support, the present invention head 4 is always small to facilitate the cleaning of crowded back teeth, as well as the removal of the head 4 from the limited space between cheek and gums without breakage of orthodontic hardware and wires, particularly in small teen or pre-teen mouths. When conical brushes 10 are attached to a present invention toothbrush head 4, the twisted wires 12 of opposed brushes 10 are angled toward one another to create a narrow trench 14 of substantially uniform width dimension, otherwise the brush bristles on narrow end 16 be too far apart to effectively reach all tooth surfaces that require cleaning to prevent decay. Also, the twisted wires 12 in the tapered ends 18 of brushes are angled toward the toothbrush head 4 to make a more compact profile for reaching crowded back teeth without damaging orthodontic hardware and wires. Optionally, the present invention toothbrush handle 6 can be laterally angled relative to its attached head 4 and the brushes 10 can be removably attached to the present invention toothbrush head 4 for user replacement of worn brushes 10 or 20 once they are no longer effectively serviceable. Further, movement of the twisted wire brush bristles 10 or 20 relative to a user's teeth and orthodontic wires can be accomplished manually or with electric embodiments that counter-rotate bristles to pull food out and away from teeth. Although not shown, a self-cleaning flap may also be an option for electric embodiments of the present invention. Not only does use of the present invention provide more effective cleaning of tooth surfaces in and around orthodontic wires and complementary tooth hardware, it accomplishes a thorough cleaning is less time.

FIGS. 1 and 2 shows a first preferred embodiment 2 of the present invention having two pairs of conical twisted wire brushes 10 forming a trench 14 for an orthodontic wire (not shown) with the bristles of opposing brushes 10 very slightly overlapping one another and the wider ends 16 of brushes 10 being secured to the middle portion of a solid-tipped toothbrush head 4. The twisted wires 12 on each end of the conical brushes 10 shown in FIGS. 1 and 2 are not connected to toothbrush head 4. Instead, the portion of the bristles of conical brushes 10 being positioned adjacent to toothbrush head 4 are secured thereto via glue, adhesives, bonding agents, and the like, or combination thereof. Since toothbrush head 4 is inserted into a human mouth, any glue, adhesive, bonding agent, or other fastening means between conical brushes 10 and toothbrush head 4 must be non-toxic. To maintain the uniform width of trench 14, at the narrow end 18 of conical brushes 10, the twisted wires 12 of opposing brushes 10 are angled toward one another. At the narrow end 18 of conical brushes 10, the twisted wires 12 of opposing brushes 10 are also angled toward toothbrush head 4 to minimize the profile of head 4 and brush 10 when they are inserted into and removed from the small space between check and gum to clean plaque and food from back teeth. FIG. 1 also shows a grip-enhancing surface 8 on the distal end of handle 6 for improved hand control of first preferred embodiment 2. FIG. 1 also shows toothbrush head 4 being aligned with toothbrush handle 6. As shown in FIGS. 1 and 2, with the twisted wires 12 not being in direct contact with toothbrush head 4 and the bristles of conical brushes 10 being secured to toothbrush head 4 via glue, adhesives, bonding agents, and the like, or combination thereof, it is contemplated that the first preferred embodiment 2 would be manufactured as a disposable embodiment that would be replaced in its entirety when brushes 10 are worn out, and not allow individual brush 10 replacement by the user, such as user 42 in FIGS. 10 and 11.

FIG. 3 shows a second preferred embodiment 26 of the present invention having one pair of cylindrical twisted wire brushes 20 secured to a toothbrush head 4, with one brush 20 in the pair being directly behind the other and hidden from view. FIG. 3 further shows the proximal end 24 of the twisted wires 12 of brushes 20 being attached to the end of toothbrush head 4 adjacent to the handle 6, and the distal end 22 of the twisted wires 12 of brushes 20 being attached to the free end of toothbrush head 4. Although cylindrical brushes 20 can be used and are considered to be within the scope of the present invention, for small teen and pre-teen mouths the use of conical brushes 10 would be preferred. FIG. 3 also shows the twisted wire 12 of the visible cylindrical brush 20 being substantially parallel to the upper surface of toothbrush head 4. To present a more compact configuration for reaching crowded back teeth with a cylindrical brush 20, although not shown, it is contemplated that the top surface of toothbrush head 4 could be tapered so that its free end is narrowed relative to its distal end, and the twisted wires 12 of brushes 20 bent toward the tapering top surface until the bristles of brushes 20 that face the top surface of toothbrush head 4 are in close association with it. If second preferred embodiment 26 is manufactured as a device with replaceable brushes 20, and twisted wires 12 are sufficiently strong to hold brushes 20 in a fixed position relative to toothbrush head 4 as head 4 is inserted into the small space between a cheek and gums to reach back teeth, then no additional fastening means is required to hold any of the bristles of brushes 20 against the top surface of toothbrush head 4. In the alternative, although not shown, any type of non-toxic adhesive, glue, bonding agent, and the like, or combination thereof can be used whereby second preferred embodiment 26 would be manufactured as a disposable embodiment that would be replaced in its entirety when brushes 20 are worn out.

FIG. 4 shows a third preferred embodiment 28 of the present invention having two pairs of conical twisted wire brushes 10 secured to the top surface of a toothbrush head 4, with one brush 20 in each pair being directly behind the other and hidden from view. The twisted wire 12 in the wide end 16 of each visible brush 10 is shown being attached into the middle portion of toothbrush head 4, while the narrow end 18 of one of the visible brushes 10 being shown positioned at the free end of toothbrush head 4 and the narrow end 18 of the remaining visible brush 10 being shown positioned at the proximal end of toothbrush head 4 and adjacent to handle 6. Third preferred embodiment 28 could alternatively be configured whereby brushes 20 are individually replaceable as they become worn and no longer effective, or as a disposable embodiment that would be replaced in its entirety when brushes 10 are worn out. FIG. 4 shows twisted wires 12 being angled toward the top of toothbrush head 4 at narrow ends 18.

Figure 5:
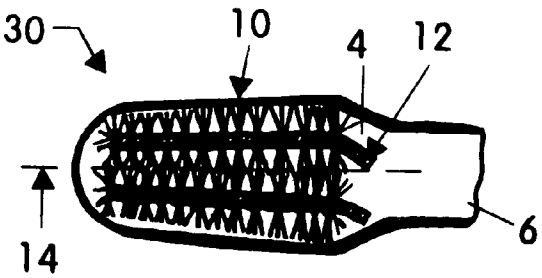
FIG. 5 is a front view of the fourth preferred embodiment of the present invention having two pairs of conical twisted wire brushes secured to a solid-tipped toothbrush head, with the twisted wire of each brush being attached to the proximal end of the toothbrush head, and further with brush bristles nearly overlapping.

FIG. 5 shows a fourth preferred embodiment 30 of the present invention having two pairs of slightly tapering conical-shaped twisted wire brushes 10 secured to a solid-tipped toothbrush head 4, with the twisted wire 12 of each brush 10 being attached to the proximal end of the toothbrush head 4, near to handle 6. The twisted wires 12 are not parallel to one another, instead angling toward one another. FIG. 5 further shows the bristles of opposing brushes 10 extending a small distance into trench 14, in a slightly overlapping configuration. In contrast, FIG. 6 shows the second preferred embodiment 26 of the present invention having two pairs of cylindrical twisted wire brushes 20 secured to a solid-tipped toothbrush head 4, with the bristles of brushes 20 not crossing trench 14. The choice as to whether the bristles of brushes 10 or 20 overlap within trench 14 would depend upon other factors, such as but not limited to the length and softness of the material used to form them. Since the twisted wire 12 of each brush 20 shown in FIG. 6 is also attached to the proximal end of toothbrush head 4 near to handle 6, both preferred embodiments 30 and 26 could be manufactured for individual brush 10 or 20 replacement as they become worn, or as disposable embodiments that are replaced in the entirety when brushes 10 or 20 become worn to the extent that they are no longer effective.

Figure 7:
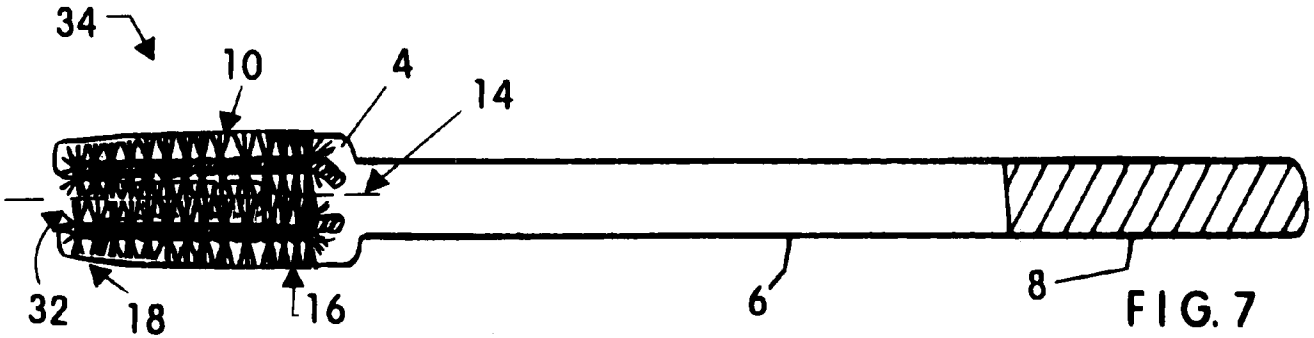
FIG. 7 is a front view of a fifth preferred embodiment of the present invention having one pair of elongated conical twisted wire brushes forming a trench for insertion of an orthodontic wire that allows brush bristles to gently reach around the orthodontic wire and contact tooth surfaces beneath the orthodontic wire for effective plaque and food removal, with brush bristles nearly overlapping and the wider ends of the brushes secured to the proximal end of a split configuration toothbrush head, and also with the toothbrush head being aligned with the toothbrush handle.

FIG. 7 shows a fifth preferred embodiment 34 of the present invention having one pair of elongated conical twisted wire brushes 10 forming a narrow trench 14 with a substantially uniform width dimension that is used for insertion of an orthodontic wire (not shown) whereby the bristles of brushes 10 are able to gently reach around the orthodontic wire and contact tooth surfaces behind the orthodontic wire for effective plaque and food removal. The bristles of opposing brushes 10 are nearly overlapping and the wider ends 16 of brushes 10 are secured to the proximal end of toothbrush head 4. To achieve the uniform configuration of trench 14, the twisted wires 12 at the narrow ends 16 of brushes 10 are angled slightly toward one another. An optional gripping material or texture 8 is shown on the distal end of handle 6. Further, FIG. 7 shows toothbrush head 4 having a split configuration similar to that of a tuning fork, with a longitudinal gap 32 extending through its free end and the central portion of toothbrush head 4. Gap 32 permits the insertion of an orthodontic wire deeper within trench 14, and the availability of more bristles on brushes 10 to clean plaque and food particles from the tooth surfaces situated behind orthodontic wires. In FIG. 7, toothbrush head 4 is aligned with handle 6. However, it is contemplated for the present invention to include embodiments having a split configuration head 4 that is laterally angled relative to its associated handle 6. Since the twisted wires 12 of fifth preferred embodiment 34 secure brushes 10 to toothbrush head 4, fifth preferred embodiment 34 could be manufactured for individual brush 10 replacement as they become worn, or as a disposable embodiment intended for total replacement when brushes 10 are no longer effective for tooth cleaning. Optionally, depending upon the bending characteristics of twisted wires 12 and other factors, it is contemplated that glue, adhesives, bonding agents, and the like, or combination thereof, could be used to secure the narrow ends 18 of brushes 10 to toothbrush head 4 in disposable embodiments where needed to avoid movement of twisted wires 12 away from toothbrush head 4 and the risk of injury as a result of such movement to orthodontic wires, brace hardware, and/or the user as toothbrush head 4 is inserted between the cheek and gums of a user to reach crowded back teeth.

Figure 8:
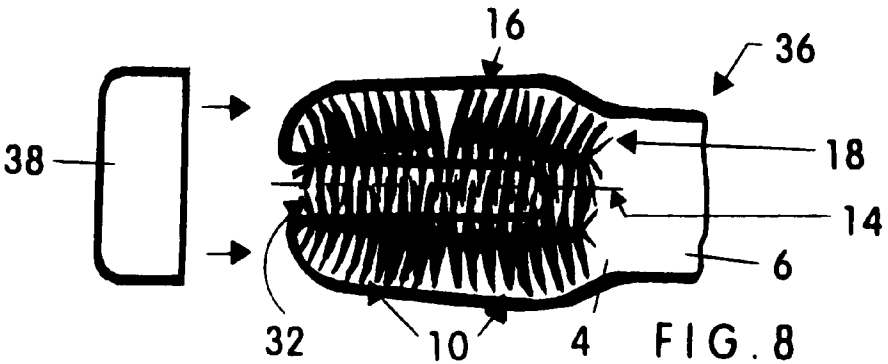
FIG. 8 is a front view of a sixth preferred embodiment of the present invention having two pairs of conical twisted wire brushes forming a trench for an orthodontic wire with brush bristles slightly overlapping and the wider ends of the brushes secured to the middle portion of a split configuration toothbrush head, with a cap or hood usable over the distal end of the head and its associated brush to maintain the portion of each brush at the distal end in a position close to the adjacent part of the head so as to facilitate insertion of the combined head and brush into small mouths and the cleaning of back teeth.

FIG. 8 shows a sixth preferred embodiment 36 of the present invention having two pairs of conical twisted wire brushes 10 forming a trench 14 with a substantially uniform width dimension that is used for insertion of an orthodontic wire whereby the bristles of brushes 10 are able to gently reach around the orthodontic wire and achieve closer contact with all tooth surfaces behind the orthodontic wire for effective plaque and food removal. To achieve the uniform configuration of trench 14, the twisted wires 12 at the narrow ends 16 of brushes 10 are angled toward one another. FIG. 8 also shows the bristles of opposing brushes 10 to be overlapping and toothbrush head 4 having a split configuration similar to that of a tuning fork, with a longitudinal gap 32 extending through its free end and the central portion of toothbrush head 4. Gap 32 permits the insertion of an orthodontic wire deeper within trench 14, and the availability of even more bristles on brushes 10 to clean plaque and food particles from the tooth surfaces situated behind orthodontic wires. FIG. 8 shows the wider ends 16 of brushes 10 being secured to the middle portion of the toothbrush head 4. FIG. 8 does not show the twisted wires 12 at the wider ends 16 of brushes 10 being inserted into toothbrush head 10, although such attachment of twisted wire 12 and toothbrush head 4 could be hidden from view. Optionally, depending upon the bending characteristics of twisted wires 12 and other factors, it is contemplated that glue, adhesives, bonding agents, and the like, or combination thereof, could be used to secure the narrow ends 18 of brushes 10 to toothbrush head 4 in disposable embodiments where needed to avoid movement of twisted wires 12 away from toothbrush head 4 and the risk of injury as a result of such movement to orthodontic wires, brace hardware, and/or the user as toothbrush head 4 is inserted between the cheek and gums of a user to reach crowded back teeth. Thus, sixth preferred embodiment 36 could be manufactured for individual brush 10 replacement as they become worn, or as a disposable embodiment intended for total replacement when brushes 10 are no longer effective for tooth cleaning. As an alternative to glue, adhesives, bonding agents, and the like, or the insertion of twisted wires 12 directly into the top surface of toothbrush head 4, FIG. 8 shows a cap or hood 38 for use in covering the free end of toothbrush head 4 when it is inserted into the mouth of a user to reach crowded back teeth, so as to maintain the close association of the narrow ends 16 of brushes 10 and the free end of toothbrush head 4 to prevent injury to the user's mouth and gums, as well as prevent damage to brace hardware and orthodontic wires. Although not shown, the connection of cap or hood 38 to the free end of toothbrush head 4 can vary. It is contemplated for cap or hood 38 to removably slide over the free end of toothbrush head 4, however, permanent attachment of cap or hood 38 to toothbrush head 4 is also contemplated for disposable embodiments of the present invention. Further, although cap or hood 38 is shown to have a substantially rectangular configuration and an unadorned surface, the cap or hood 38 shown is only one representation thereof and it is considered to be within the scope of the present invention for cap or hood 38 to have a variety of different configurations and appearances other than that shown in FIG. 8. One optional procedure for replacement of brushes 10 or 20 in preferred embodiments of the present invention when cap or hood 38 is used, would require removal of the used brush 10 or 20, sliding the twisted wire 12 on one end of the replacement brush into a hole in top surface of the proximal end of toothbrush head 4, and then bending the twisted wire 12 on the remaining end toward toothbrush head 4, followed by a step of sliding cap or hood 38 over the free ends of toothbrush head 4 and the attached brushes 10 or 20 to secure all free ends together and maintain them in a fixed association during teeth cleaning use. As an option, it is contemplated for cap or hood 38 to have elastic or otherwise biasing properties to assure effectiveness in holding all three free ends together during teeth cleaning use. Cap or hood 38 would prevent left or right movement of brushes 10 or 20 that could otherwise provide a risk of injury to the cheek and gums of the user.

Figure 9:
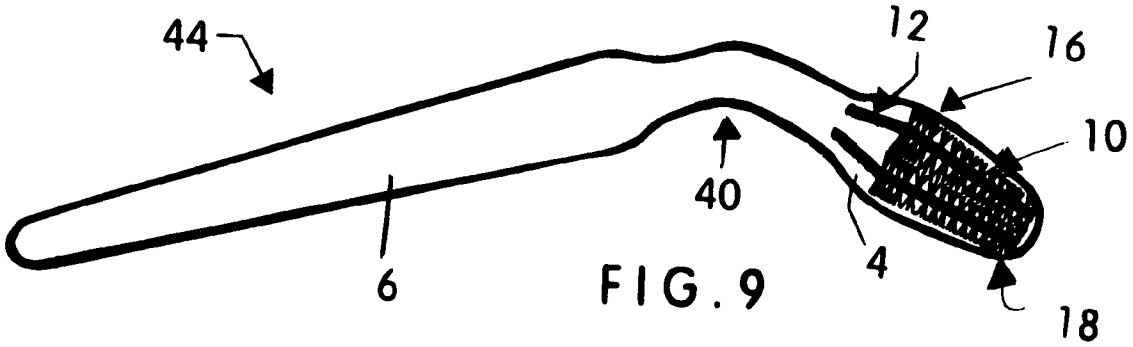
FIG. 9 is a front view of a seventh preferred embodiment of the present invention having one pair of conical twisted wire brushes forming a trench for an orthodontic wire with brush bristles nearly overlapping and the wider ends of the brushes secured to the proximal end of a solid-tipped toothbrush head, with the toothbrush head being laterally angled relative to the attached toothbrush handle.
Figure 11:
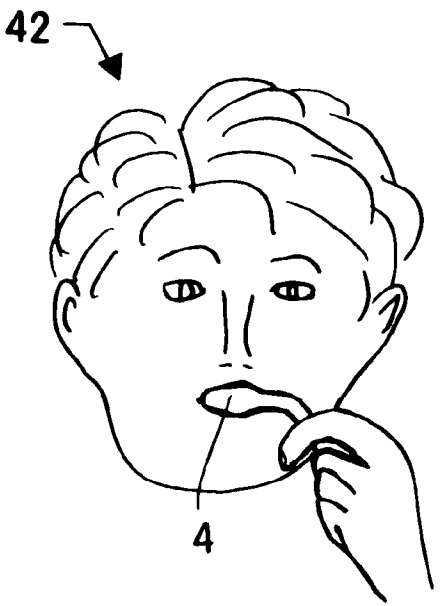
FIG. 11 also shows an alternative user grip on the seventh preferred embodiment of the present invention that achieves a horizontally-extending orientation of the trench between opposing pairs of brush bristles for effective cleaning of back teeth on the opposite side of the mouth without premature fatigue in the user's arm.
Figure 10:
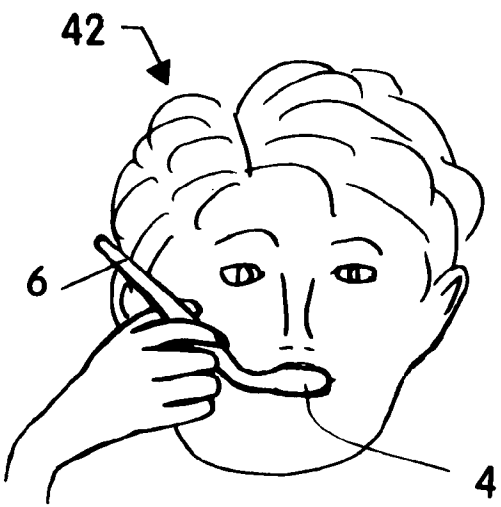
FIG. 10 shows a user's pencil-like grip on the seventh preferred embodiment of the present invention that achieves a horizontally-extending orientation of the trench between opposing pairs of brush bristles for reaching back teeth without a corresponding raising of the user's arm that would likely lead to premature arm fatigue and inefficient tooth cleaning.

FIGS. 9-11 show seventh preferred embodiment 44 of the present invention with the toothbrush head 4 being angled laterally relative to the attached toothbrush handle 6. Lateral angling of toothbrush head 4 is particularly useful in maintaining orthodontic wires in trench 14 as crowded back teeth are being cleaned and the lip of a user 42 has the tendency to move the orthodontic wire from trench 14 before tooth cleaning is complete. The angle 40 between toothbrush head 4 and handle 6 is not limited to the approximately 45° angle shown in FIG. 9, but preferably would be between approximately 30° and 60°, although not strictly limited thereto. FIG. 9 shows seventh preferred embodiment 44 having one pair of conical twisted wire brushes 10 forming a narrow and uniform trench 14 for insertion of an orthodontic wire, with the bristles of opposing brushes 10 nearly overlapping. The wider ends 16 of the brushes 10 are secured to the proximal end of a solid-tipped toothbrush head 4. In the alternative, other toothbrush heads 4 could be used, such as one having a tapered, blunt, or tuning fork configuration. As shown in FIGS. 9-11, the preferred toothbrush head 4 is small, for effective use in the small mouths of teens and pre-teens 42. FIGS. 10 and 11 show how an angled toothbrush head embodiment of the present invention, such as but not limited to seventh preferred embodiment 44, would be used. FIGS. 10 and 11 both show the arm of user 42 extending in an energy-conserving downward direction. FIG. 10 shows a user's 42 pencil-like grip on an embodiment of the present invention having a laterally angled toothbrush head 4 that achieves a horizontally-extending orientation of the trench 14 between opposing pairs of brush bristles 10 without also requiring a horizontally extended position of a user's 42 arm that would likely lead to premature arm fatigue and inefficient cleaning of tooth surfaces. In contrast, FIG. 11 also shows an alternative user's 42 grip on an embodiment of the present invention having an angled toothbrush head 4 that achieves a horizontally-extending orientation of the trench 14 between opposing pairs of brush bristles 10 without premature fatigue in the user's 42 arm, particularly when back teeth are being reached. Although not shown, forward angling, and or a combination of lateral and forward angling can be used to provide benefit in reaching back teeth.

Figure 12:
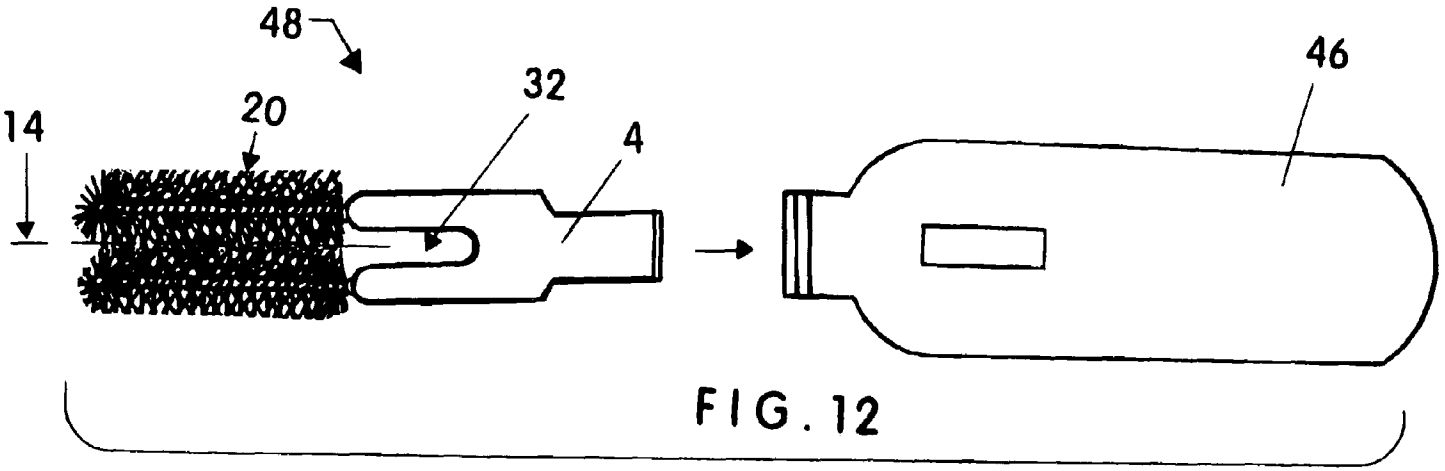
FIG. 12 is a side view of a preferred electric powered embodiment of the present invention with detachable head and cylindrical brushes creating a narrow uniform trench for orthodontic wires.
Figure 13:
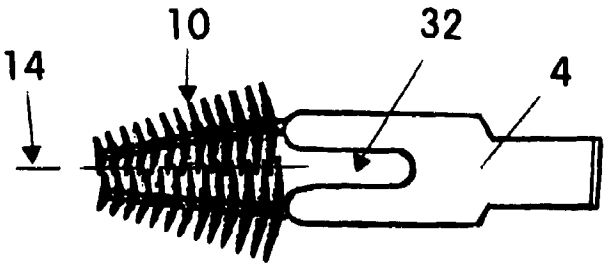
FIG. 13 is a side view of a second preferred embodiment of a toothbrush head for use as a part of a preferred electric powered embodiment of the present invention and having conical brushes defining a small and uniform trench for orthodontic wires.
Figure 15:
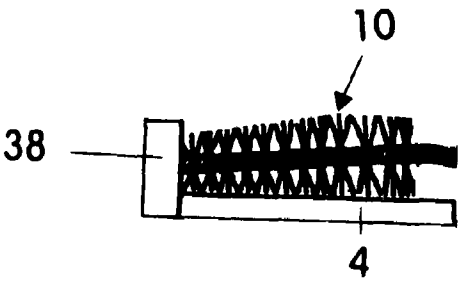
FIG. 15 is a side view of a third preferred embodiment of a toothbrush head for use as a part of a preferred electric powered embodiment of the present invention and having conical brushes with an end cap or hood to protect orthodontic wires.
Figure 14:
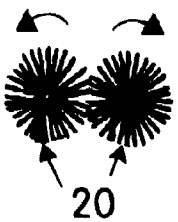
FIG. 14 is an end view of the counter-rotation preferred in brushes of electric powered embodiments of the present invention.

FIGS. 12-15 show preferred features of some of the electric powered embodiments of the present invention, which can be battery powered, have a power cord with or without an attached battery charger (not shown), or both. FIG. 12 shows preferred electric powered embodiment 48 having a detachable head 4 and a wide bodied handle 46 that can optionally contain a battery operated source of power (not shown). Cylindrical brushes 20 are each attached to one of the split ends of toothbrush head 4 to create a narrow trench 14 of uniform width dimension for orthodontic wires that is substantially aligned with gap 32. Brushes 20 can be individually replaced as they become worn and no longer serviceable, or in the alternative, the entire 4-brush 20 head unit can be discarded and replaced with a new one. FIG. 13 shows a second preferred embodiment of a toothbrush head 4 for optional use as a part of preferred electric powered embodiment 48, and the bristles of conical brushes 10 also are positioned to define a small and uniform trench 14 for orthodontic wires. FIG. 14 shows the counter-rotation preferred in brushes of electric powered embodiments of the present invention, such as the electric powered embodiment 48 in FIG. 12, which tends to be most effective in pulling food out of orthodontic hardware. Although not shown, a self-cleaning flap may also be an option for electric embodiments of the present invention. FIG. 15 is a side view of third preferred embodiment of a toothbrush head 4 for optional use as a part of preferred electric powered embodiment 48. The distal ends of conical brushes 10 rotate within an end cap or hood 38 that upwardly depends from the free end of toothbrush head 4 to protect orthodontic wires and tooth hardware as toothbrush head 4 is inserted between cheek and gums to reach back teeth. The thickness of toothbrush head 4 relative to brush 10 and cap or hood 38, as well as the configuration of cap or hood 38, can be different from that shown in FIG. 15. Not only does use of the present invention electrical and non-electrical embodiments provide more effective cleaning of tooth surfaces in and around orthodontic wires and complementary tooth hardware, it accomplishes a thorough cleaning is less time.

What is claimed is:

1. A toothbrush for use by dental patients having braces with orthodontic wires, said toothbrush comprising:

an elongated handle;

a compact tapered head with a front surface, a distal end, and a proximal end, wherein said handle depends from said proximal end; and two pair of conical twisted wire brushes, each of said brushes having a narrow end and a wide end and a plurality of radially extending bristles;

wherein two of said narrow ends extend toward said distal end of said head, and two of said narrow ends extend toward said proximal end of said head;

wherein said brushes are longitudinally secured to said front surface of said head and each of said brushes having a plurality of bristles extending toward and being in contact with said head, said brushes being positioned non-parallel to one another and non-parallel to said head, when not in use, so that a very narrow trench of substantially uniform width is created longitudinally along the centerline of said head, wherein when said very narrow trench is placed in a horizontally extending position around the orthodontic wires attached to a user's brace hardware, the ones of said bristles being adjacent to said trench will close in around the orthodontic wires of the brace hardware and reach behind the orthodontic wires to effectively clean exposed tooth surfaces behind the orthodontic wires, even tooth surfaces of the rear teeth positioned where there is little space between cheek and tooth, and when said head is withdrawn from the user's mouth, said brushes and said head do not cause any damage to the brace hardware or orthodontic wires.

2. The toothbrush of claim 1 wherein said compact head is angled relative to said handle.

3. The toothbrush of claim 1 wherein said compact head is laterally angled relative to said handle within an approximate range of thirty to sixty degrees.

4. The toothbrush of claim 1 wherein said twisted wire brushes are replaceable.

5. The toothbrush of claim 1 having two pairs of said twisted wire brushes with said twisted wires of said brushes in each said pair attached centrally to said compact head between said distal end and said proximal end.

6. The toothbrush of claim 5 having two pairs of said twisted wire brushes wherein said bristles in each said pair are touching.

7. The toothbrush of claim 5 having two pairs of said twisted wire brushes wherein said bristles in each said pair are slightly overlapping.

8. The toothbrush of claim 1 wherein said handle is selected from a group consisting of handles having gripping material attached thereto, and handles having gripping texture.

9. The toothbrush of claim 1 wherein said handle is selected from a group consisting of handles adapted for manual movement of said compact head, and handles adapted for electrical movement of said compact head.

10. The toothbrush of claim 1 wherein said twisted wire brushes are secured to said compact head through attachment means selected from a group consisting of direct contact of said twisted wires of said brushes to said compact head, non-toxic bonding agents securing said twisted wires to said compact head, non-toxic bonding agents securing said brush bristles to said compact head, non-toxic glues securing said twisted wires to said compact head, non-toxic glues securing said brush bristles to said compact head, non-toxic adhesives securing said twisted wires to said compact head, and non-toxic adhesives securing said brush bristles to said compact head.

11. The toothbrush of claim 1 wherein said compact head is replaceable.

12. A method of cleaning tooth surfaces of back teeth behind brace hardware and associated orthodontic wires in the limited space between tooth and cheek, without damaging the brace hardware and associated orthodontic wires, and without injury to the user during and after back teeth are cleaned, said method comprising the steps of: providing a toothbrush, said toothbrush comprising:

an elongated handle;

a compact tapered head with a front surface, a distal end, and a proximal end, wherein said handle depends from said proximal end; and two pair of conical twisted wire brushes, each of said brushes having a narrow end and a wide end and a plurality of radially extending bristles;

wherein two of said narrow ends extend toward said distal end of said head, and two of said narrow ends extend toward said proximal end of said head;

wherein said brushes are longitudinally secured to said front surface of said head and each of said brushes having a plurality of bristles extending toward and being in contact with said head, said brushes being positioned non-parallel to one another and non-parallel to said head, when not in use, so that a very narrow trench of substantially uniform width is created longitudinally along the centerline of said head;

placing said very narrow trench in a horizontally extending position around the orthodontic wires attached to said brace hardware so that the ones of said bristles being adjacent to said very narrow trench will close in around the orthodontic wires of the brace hardware and provide effective cleaning of exposed surfaces behind the orthodontic wires when said bristles are moved; and withdrawing said head whereby the compact configuration of said head and said brushes do not permit damage to the brace hardware, orthodontic wires, and user.

13. The method of claim 12 wherein said compact head is angled relative to said handle.

* * * * *